US006920811B2

(12) United States Patent
Hsien

(10) Patent No.: US 6,920,811 B2
(45) Date of Patent: Jul. 26, 2005

(54) BENT WRENCH HAVING TORQUE MEASUREMENT FUNCTION

(76) Inventor: Chih-Ching Hsien, 58 Ma Yuan West St., Taichung (TW)

( * ) Notice: Subject to any disclaimer, the term of this patent is extended or adjusted under 35 U.S.C. 154(b) by 0 days.

(21) Appl. No.: 10/638,934

(22) Filed: Aug. 8, 2003

(65) Prior Publication Data

US 2005/0028656 A1 Feb. 10, 2005

(51) Int. Cl.[7] ..... B25B 23/14
(52) U.S. Cl. ..... 81/467; 81/177.1
(58) Field of Search ..... 81/467, 468, 177.1, 81/489

(56) References Cited

U.S. PATENT DOCUMENTS 1,793,714 A * 2/1931 Newberg ..... 81/125.1
4,006,629 A * 2/1977 Barrett et al. ..... 73/862.26
4,522,075 A * 6/1985 Pohl ..... 73/862.23
5,172,614 A * 12/1992 Monnet et al. ..... 81/119
D481,276 S * 10/2003 Hu ..... D8/28
D481,613 S * 11/2003 Macor ..... D8/107
6,655,239 B1 * 12/2003 Macor ..... 81/125.1

FOREIGN PATENT DOCUMENTS

FR 2626514 A1 * 8/1989 ..... B25B/23/14

* cited by examiner

*Primary Examiner*—David B. Thomas

(57) ABSTRACT

A bent wrench includes a wrench body including a handle formed with a bent portion, and at least one strain gauge mounted on a connection of the handle and the bent portion to measure the torque of the wrench body. Thus, the strain gauge is extended through the connection of the bent portion and the two ends of the handle and can measure the torque of the wrench body in the optimum manner due to the smallest structural strength of the connection of the bent portion and the two ends of the handle, so that the strain gauge can measure the torque of the wrench body exactly and optimally.

8 Claims, 5 Drawing Sheets

BENT WRENCH HAVING TORQUE MEASUREMENT FUNCTION

BACKGROUND OF THE INVENTION

1. Field of the Invention

The present invention relates to a bent wrench, and more particularly to a bent wrench having a torque measurement function.

2. Description of the Related Art

A conventional wrench comprises a handle formed with a receiving space, and a strain gauge mounted in the receiving space of the handle to measure the torque value of the conventional wrench. However, the handle of the conventional wrench has an enhanced strength, so that the strain gauge mounted in the receiving space of the handle cannot measure the torque value of the conventional wrench easily and exactly. In addition, the strain gauge is hidden in the receiving space of the handle, thereby causing inconvenience to the user in replacement and maintenance of the strain gauge.

SUMMARY OF THE INVENTION

The primary objective of the present invention is to provide a bent wrench having an exact torque measurement function.

Another objective of the present invention is to provide a bent wrench, wherein the strain gauge is extended through the connection of the bent portion and the two ends of the handle and can measure the torque of the wrench body in the optimum manner due to the smallest structural strength of the connection of the bent portion and the two ends of the handle, so that the strain gauge can measure the torque of the wrench body exactly and optimally.

A further objective of the present invention is to provide a bent wrench, wherein the strain gauge and the indication device are bonded on the handle, thereby facilitating replacement and maintenance of the strain gauge and the indication device.

In accordance with the present invention, there is provided a bent wrench, comprising:

a wrench body including a handle formed with a bent portion; and at least one strain gauge mounted on a connection of the handle and the bent portion to measure the torque of the wrench body.

Further benefits and advantages of the present invention will become apparent after a careful reading of the detailed description with appropriate reference to the accompanying drawings.

DETAILED DESCRIPTION OF THE INVENTION

Figure 1:
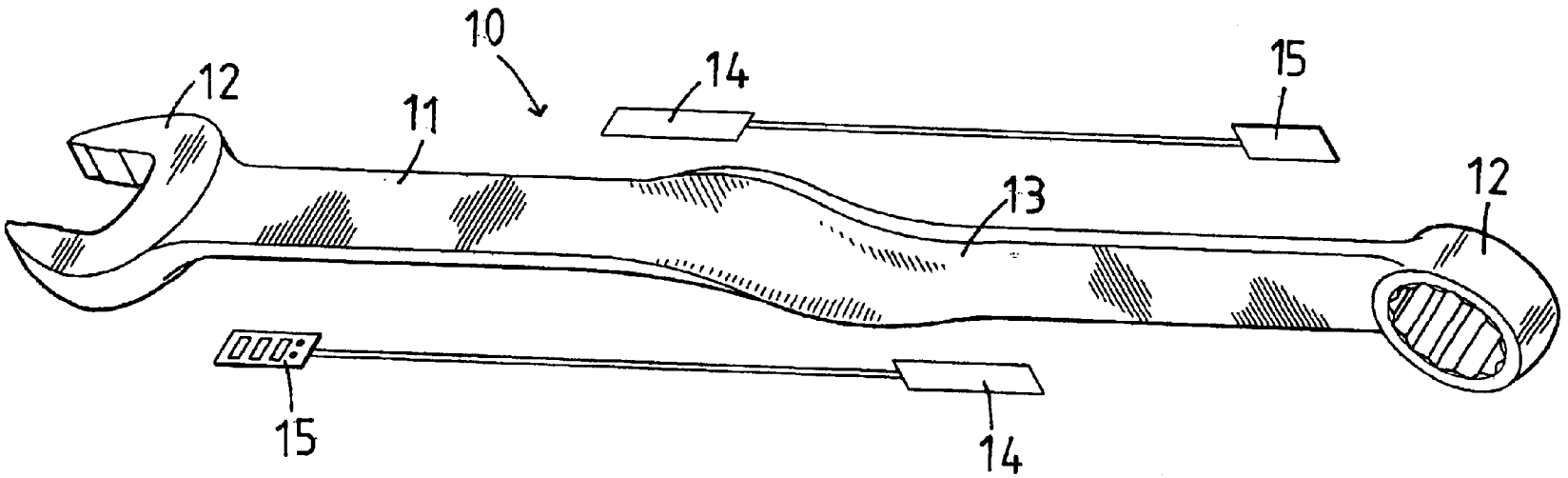
FIG. 1 is an exploded perspective view of a bent wrench in accordance with the preferred embodiment of the present invention.
Figure 2:
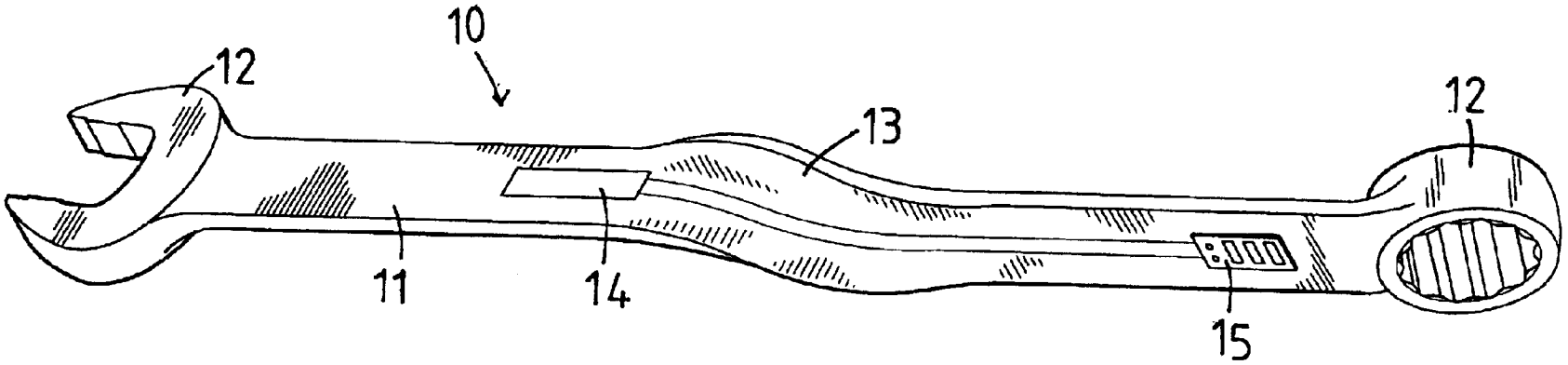
FIG. 2 is perspective assembly view of the bent wrench as shown in FIG. 1.
Figure 3:
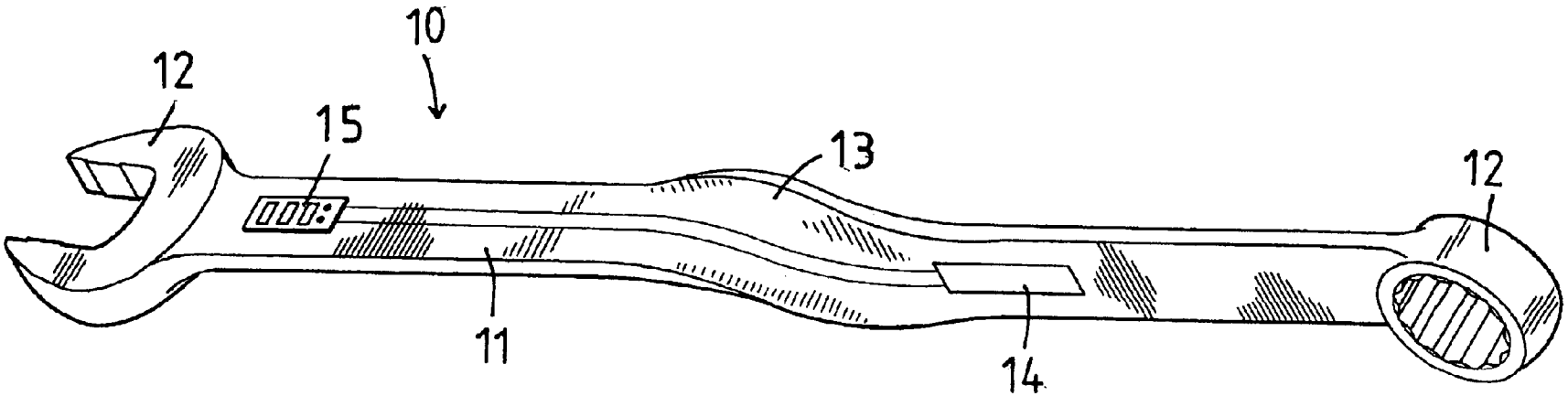
FIG. 3 is perspective assembly view of the bent wrench as shown in FIG. 1.

Referring to the drawings and initially to FIGS. 1–3, a bent wrench in accordance with the preferred embodiment of the present invention comprises a wrench body 10 including a handle 11 having two ends each provided with a mounting portion 12 and having a mediate section formed with a bent portion 13 located between the two ends of the handle 11. Preferably, the bent portion 13 is distorted in a vertical manner, so that the two ends of the handle 11 are vertical to each other.

The bent wrench further comprises at least one strain gauge 14 mounted on the handle 11 and located adjacent to the bent portion 13. Preferably, the bent wrench comprises two strain gauges 14 mounted on two sides of the handle 11. Preferably, the strain gauge 14 is extended through the connection of the bent portion 13 and the two ends of the handle 11.

The strain gauge 14 has a distal end provided with an indication device 15. Thus, the indication device 15 of the strain gauge 14 can indicate the torque values measured by the strain gauge 14 in a digital manner. The resistance value measured by the strain gauge 14 is converted into a digital signal, and operation of the strain gauge 14 and the indication device 15 is conventional and will not be further described in detail.

Figure 4:
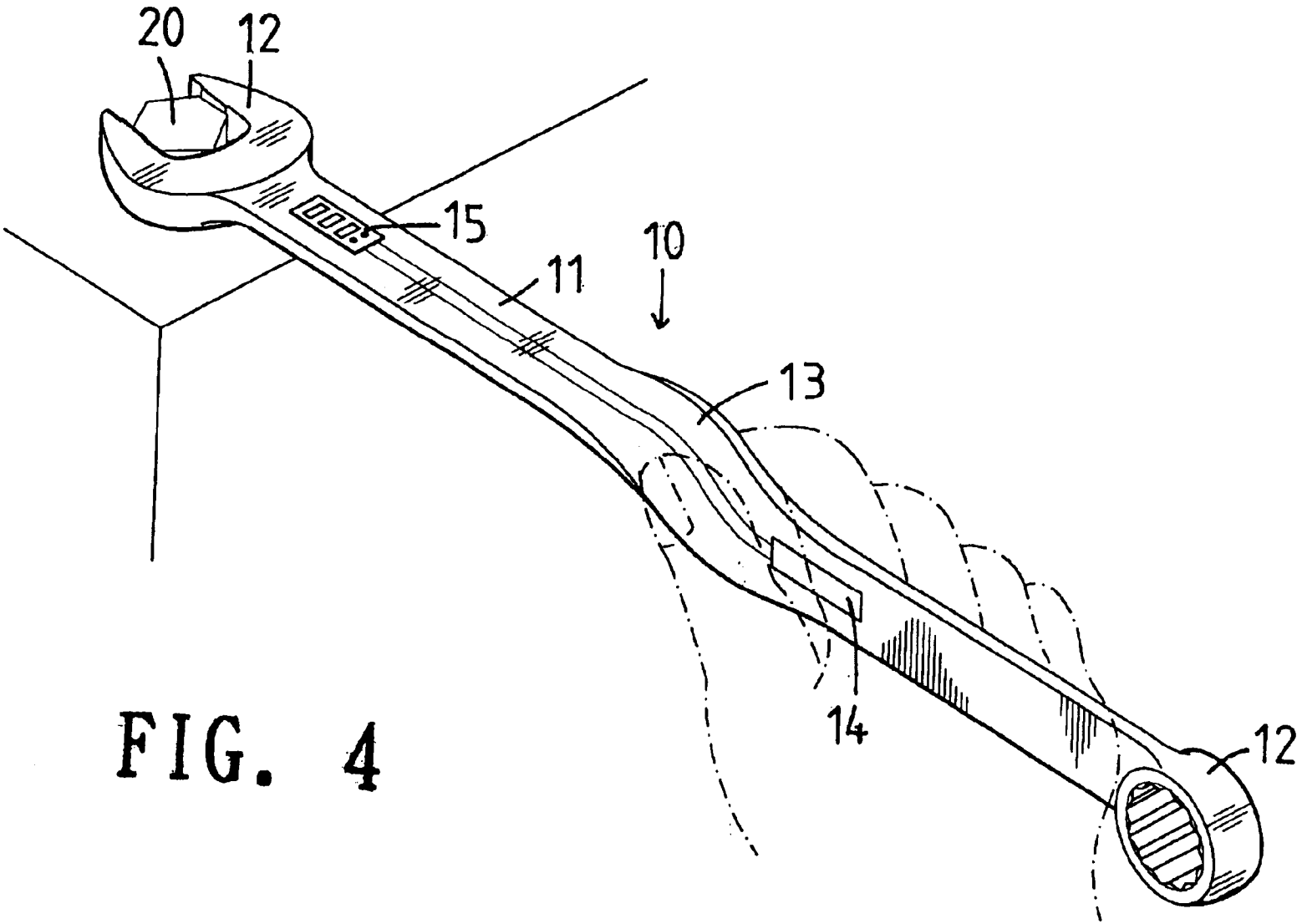
FIG. 4 is a schematic operational view of the bent wrench as shown in FIG. 3 in use.

Accordingly, the connection of the bent portion 13 and the two ends of the handle 11 has the smallest structural strength. Thus, as shown in FIG. 4, when the user's one hand holds the bent portion 13 of the wrench body 10 to rotate the handle 11 to drive a workpiece 20, such as a nut or the like, the strain gauge 14 that is extended through the connection of the bent portion 13 and the two ends of the handle 11 can measure the torque of the wrench body 10 in the optimum manner due to the smallest structural strength of the connection of the bent portion 13 and the two ends of the handle 11, so that the strain gauge 14 can measure the torque of the wrench body 10 exactly and optimally. Then, the indication device 15 of the strain gauge 14 can indicate the torque values measured by the strain gauge 14 in a digital manner.

In addition, the strain gauge 14 and the indication device 15 are bonded on the handle 11, thereby facilitating replacement and maintenance of the strain gauge 14 and the indication device 15.

Figure 5:
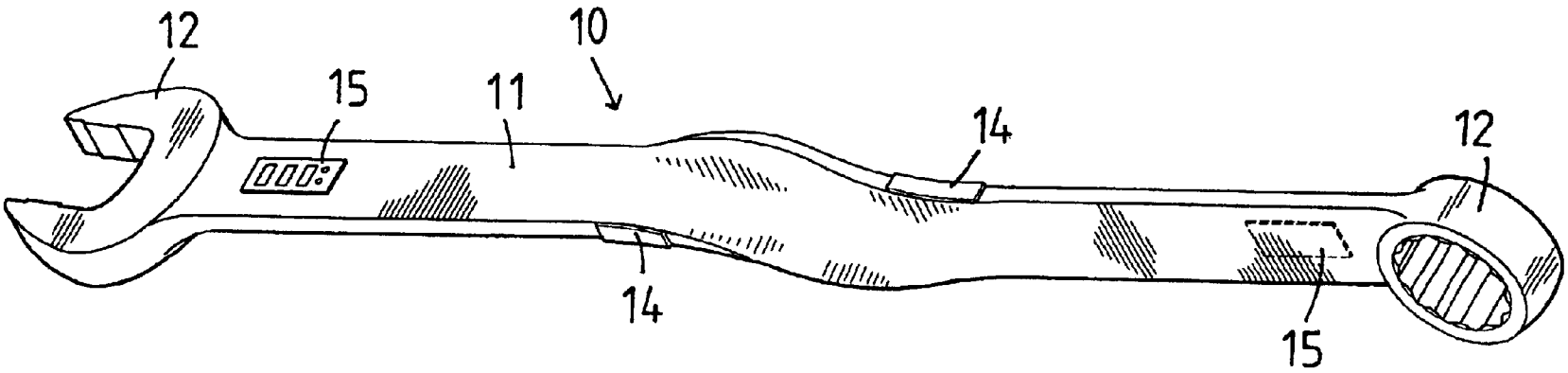
FIG. 5 is a perspective assembly view of the bent wrench in accordance with another embodiment of the present invention.

Referring to FIG. 5, the strain gauge 14 is mounted on a narrower portion of the handle 11.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A bent wrench, comprising:

a wrench body including a handle formed with a bent portion; and at least one strain gauge mounted on a connection of the handle and the bent portion to measure the torque of the wrench body; wherein the at least one strain gauge has a distal end provided with an indication device;

the at least one strain gauge is disposed at a flat location of the bent portion of the wrench body so that the at least one strain gauge has a sensitive detective effect when the wrench body is subjected to an external force.

2. The bent wrench in accordance with claim 1, wherein the bent portion is formed on a mediate section of the handle.

3. The bent wrench in accordance with claim 1, wherein the handle has two ends and the bent portion is located between the two ends of the handle.

4. The bent wrench, in accordance with claim 1, wherein the bent portion is distorted in a vertical manner, so that the two ends of the handle are perpendicular to each other.

5. The bent wrench in accordance with claim 1, wherein the handle has two opposite sides and the bent wrench comprises two symmetrically arranged strain gauges mounted on the two opposite sides of the handle.

6. The bent wrench in accordance with claim 1, wherein the handle has two ends and the strain gauge is extended through the connection of the bent portion and the two ends of the handle.

7. The bent wrench in accordance with claim 1, wherein the strain gauge and the indication device are detachably bonded on a side of the handle.

8. The bent wrench in accordance with claim 1, wherein the strain gauge is mounted on a narrower portion of the handle and located adjacent to a narrower portion of the strain gauge.

* * * * *